United States Patent [19]

Ozaki et al.

[11] Patent Number: 4,987,395

[45] Date of Patent: Jan. 22, 1991

[54] CIRCUIT BREAKER ALARM-SWITCH OPERATING APPARATUS

[75] Inventors: Seishiro Ozaki; Nobuo Asahi, both of Kanagawa, Japan

[73] Assignee: Fuji Electric Co., Ltd., Kanagawa, Japan

[21] Appl. No.: 511,098

[22] Filed: Apr. 19, 1990

[30] Foreign Application Priority Data

Jul. 6, 1989 [JP] Japan ..... 1-174681

[51] Int. Cl.[5] ..... H01H 73/12

[52] U.S. Cl. ..... 335/17; 335/172; 340/638

[58] Field of Search ..... 335/17, 172–174, 335/6; 340/650–659

[56] References Cited

U.S. PATENT DOCUMENTS

| | | | |
|---|---|---|---|
| 4,166,989 | 9/1979 | Castonguay et al. | 340/638 |
| 4,652,867 | 3/1987 | Masot | 335/17 |
| 4,760,384 | 7/1988 | Vila-Masot | 335/17 |

*Primary Examiner*—Leo P. Picard
*Assistant Examiner*—Lincoln Donovan
*Attorney, Agent, or Firm*—Finnegan, Henderson, Farabow, Garrett, and Dunner

[57] ABSTRACT

An alarm switch operating apparatus for operating a plurality of circuit breaker alarm switches wherein a circuit breaker crossbar is further rotated from a tripped position by a rotation of a latch through a latch receiver during a tripping operation such that an alarm switch actuator is operated by the crossbar and wherein because the insulating bar of the crossbar extends across the left and right poles of the circuit breaker, the plurality of alarm switches are easily provided without damaging the insulation of the alarm switches.

9 Claims, 9 Drawing Sheets

CIRCUIT BREAKER ALARM-SWITCH OPERATING APPARATUS

BACKGROUND OF THE INVENTION

1. The present invention relates to an apparatus for operating an alarm switch incorporated in a compact circuit breaker.

2. Description of the Related Art

Some circuit breakers such as wiring breakers incorporate an alarm switch for sending an alarm signal to a distant place when the circuit breaker performs a tripping operation due to a failure such as short-circuit. In such an alarm switch, a microswitch is used as the switch body and is generally housed in either the left or right pole of the circuit breaker.

In such a conventional circuit breaker configuration, in order to actuate the alarm switch so that it operates when the circuit breaker performs a tripping operation, typically, an alarm switch actuator is provided so as to abut directly on a latch of a central pole portion which is one of the constituent members of a switching mechanism and wherein the alarm switch actuator rotates in response to a spring force of a switching spring. In the alternative, the alarm switch actuator is arranged so as to abut an operating rod connected to the latch so as to project sidewards (for example, see Japanese Utility Model Post-exam. Publication No. 58-24362).

However, the foregoing conventional configurations have the following disadvantages.

In the configuration wherein the alarm switch actuator is arranged so as to abut directly on the latch, it is impossible, in view of the small size of the latch, to provide two alarm switch actuators to abut on the latch at the same time. Therefore, an alarm switch can only be provided on either the left or the right circuit breaker pole and not both.

On the other hand, in the configuration wherein the alarm switch actuator is arranged so as to abut an operating rod which is coupled to the latch, it is possible to provide two alarm switches on one side of the latch if the two alarm switches are aligned side by side in the axial direction with respect to the operating rod. Alternatively, it is possible to provide two alarm switches, one on the left circuit breaker pole and the other on the right circuit breaker pole, if the operating rod is arranged such that it projects left and right. However, in this configuration, the operating rod must extend through a partition between the right and left poles in the body casing so that it can rotate as the latch rotates. Accordingly, a large window must be opened in the partition between the right and left poles thereby making the insulation between the two alarm switches and the conductor at the central pole portion of the circuit breaker difficult to configure. Particularly in the case where two alarm switches are provided on one side of the latch, the insulation of the alarm switch near the central pole also becomes difficult to configure.

SUMMARY OF THE INVENTION

It is therefore an object of the present invention to solve the problems associated with the prior art.

It is another object of the present invention to provide an alarm switch operating apparatus in a circuit breaker wherein a plurality of alarm switches are easily provided without damaging the insulation of the alarm switches.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

In order to attain the above objects, the alarm switch operating apparatus according to the present invention causes a circuit breaker crossbar to be further rotated from a tripped position by a rotation of a latch during a tripping operation through a latch receiver such that an alarm switch actuator operates as an alarm switch. When the crossbar is rotated to the tripped position by the operation of an over-current tripping device such that the engagement between a claw provided at the top end of the latch and the latch receiver are released, the latch becomes unlocked and is rotated by a spring force of a switching spring. This movement of the latch is transmitted to the crossbar through the latch receiver thereby further rotating the crossbar from the tripped position. Because an insulating bar of the crossbar extends across the left and right poles of the circuit breaker, if the alarm switch actuator is arranged so as to operate by the rotation of the insulating bar, it is easy to provide two alarm switches on either one of or both of the left and right circuit breaker poles. In addition, it is not necessary to open a window in the partition between the poles in the body casing, and, therefore, the insulation between the poles is never damaged.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention. Other features and advantages of the present invention will be apparent from the following description taken in connection with the accompanying drawings showing embodiments of the present invention applied to a wiring breaker.

DETAILED DESCRIPTION OF A PREFERRED EMBODIMENT

Reference will now be made in detail to the present preferred embodiments of the invention, examples of which are illustrated in the accompanying drawings. Wherever possible, the same reference numbers will be used throughout the drawings to refer to the same or like parts.

Figure 11A:
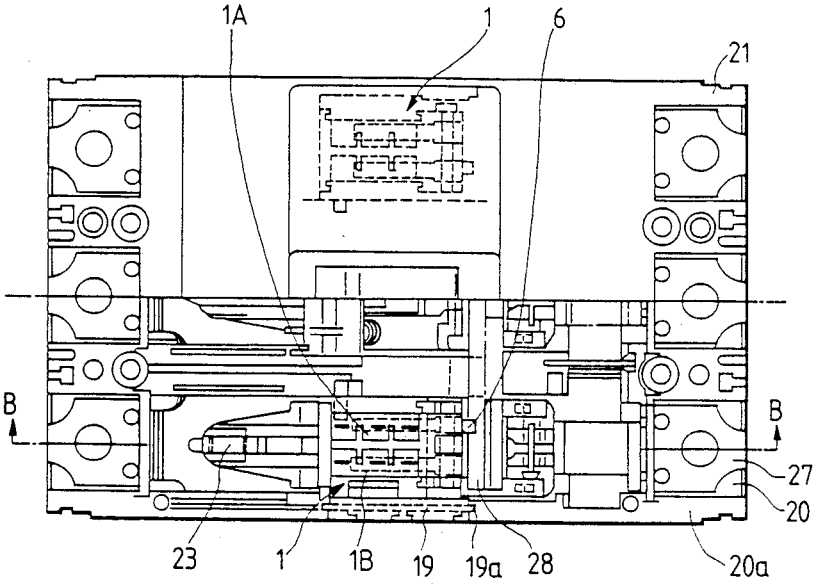
FIG. 11(A) is a plan view of the circuit breaker partly cut away so that the inside of the left half thereof can be seen.
Figure 11B:
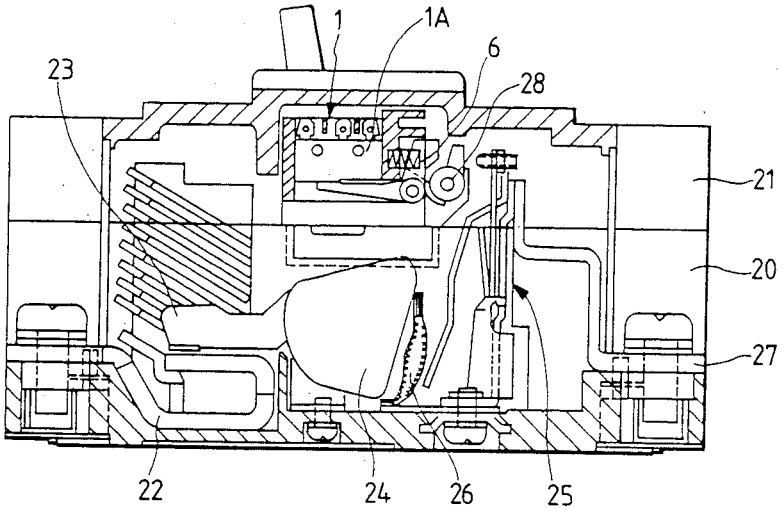
FIG. 11(B) is a sectional view of the same circuit breaker taken along line B—B in FIG. 11(A).

As shown in FIGS. 9 and 10(A)-10(C), switch unit 1 comprises microswitches 1A and 1B which are arranged in the form of a unit such that guide pins 3, provided at opposite sides of H-shaped frame 2, are fitted into respective fixing holes 4. Actuators 6 and 7, for actuating push buttons 5 provided on the lower surfaces of microswitches 1A and 1B, perform an on/-off operation of microswitches 1A and 1B and are attached at one end of frame 2 so as to be pivoted through shaft 8 at one end of frame 2. Return springs 9, comprising, for example, compression springs, are provided between frame 2 and actuators 6 and 7, respectively. In the embodiment of FIGS. 9 and 10(A)-(C), microswitch 1A is used as an alarm switch for detecting a tripping operation performed by a circuit breaker, and microswitch 1B is used as an auxiliary switch for detecting a normal opening/closing operation performed by the circuit breaker. As will be described later, actuators 6 and 7 are configured so that operating portion 6*a* of actuator 6 abuts on a crossbar, and operating portion 7*a* of actuator 7 abuts on an operating member of a holder for supporting movable contacts. Frame 2 is held by base 10 which has a U-shaped cross-section. In order to secure frame 2 to base 10, guide members 11, provided on opposite sides of frame 2, are inserted into guide grooves 12 which are correspondingly provided in base 10. Wire groove 13 is provided to lead out lead wires 14 and 15 of microswitches 1A and 1B. Lead wires 14 of microswitch 1A, however, are led to wire groove 13 through wire guides 16 provided on the top surface of frame 2, while lead wires 15 of microswitch 1B are led directly to wire groove 13. When lead wires 14 and 15 have been housed in wire groove 13, wire pressing member 17 is fitted into guide grooves 18 of base 10. Then, lead wires 14 and 15 are led out from the lower side of wire pressing member 17 to the side of base in a horizontally aligned state. As shown in FIGS. 11(A) and 11(B), assembled.switch unit 1 can be fixed to a circuit breaker by use of fixing legs 19 integrally provided on base 10 (details such as lead wires 14 and 15, etc. have been omitted). The circuit breaker includes body casing 20, cover 21 for covering body casing 20, fixed contacts 22 provided integrally with power source side terminals, movable contacts 23 arranged so as to make contact with and separate from corresponding fixed contacts 22, holder 24 pivotally provided for holding movable contacts 23, thermally-movable electromagnetic overcurrent tripping device 25, lead wires 26 for connecting movable contacts 23 to overcurrent tripping device 25, and load side terminals 27. Switch unit 1 shown in FIGS. 9 and 10(A) through 10(C) is provided for the left pole of the circuit breaker and is fixed to the circuit breaker in a manner such that fixing legs 19 are fitted into the notches formed in left wall 20*a* of body casing 20, the notches being formed so as to be in accord with the geometrical outline of fixing legs 19. As shown in FIG. 11(A), a second switch unit 1 is also provided on the right pole of the circuit breaker such that actuator 6 of alarm switch 1A is operated by crossbar 28. The configuration of crossbar 28 will be described hereunder.

Figure 3:
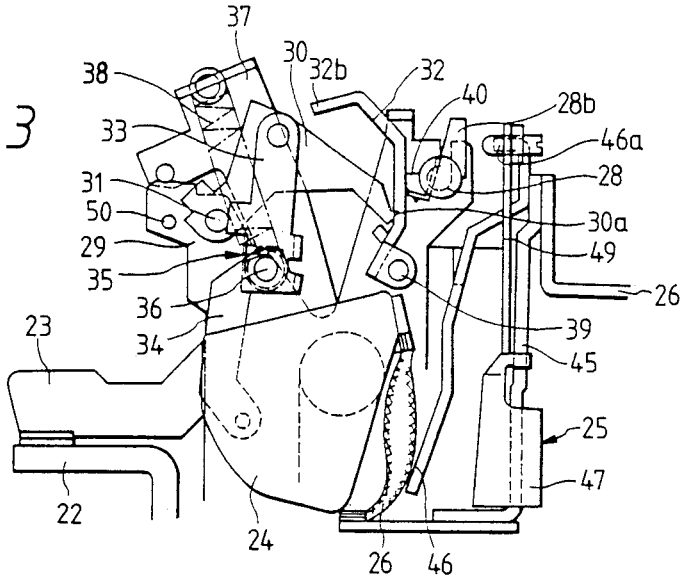
FIG. 3 is a side view of the switching mechanism portion in the turned-on state.

FIGS. 3, 4, 5(A) and 5(B) show a switching mechanism portion which is provided at the central pole of the circuit breaker of FIGS. 11(A) and 11(B). In FIG. 3, latch 30 is supported by side plate 29 of the switching mechanism so as to be pivotal through shaft 31. Latch 30 is normally prevented from rotating because claw 30*a* provided at the top end of latch 30 is locked int position by latch receiver 32. Holder 24 and latch 30 are linked to each other through toggle link 35 comprising upper link and lower link 34. Switching spring 38 is attached between central linking pin 36 of toggle link 35 and handle lever 37 pivotally supported by side plate 29. In the turned-on state of the circuit breaker, although latch has exerted thereon a counterclockwise rotational force around shaft 31 by the spring force of switching spring 38, the rotational force is borne by latch receiver 32. Thus latch receiver 32, supported by side plate 29 so as to be pivotal about shaft 39, has exerted thereon a clockwise rotational force. The clockwise rotational force, however, is borne by crossbar 28 via its claw 40 engaged with latch receiver 32 at its back surface. Crossbar 28 is also rotatably supported by side plate 29.

Figure 6A:
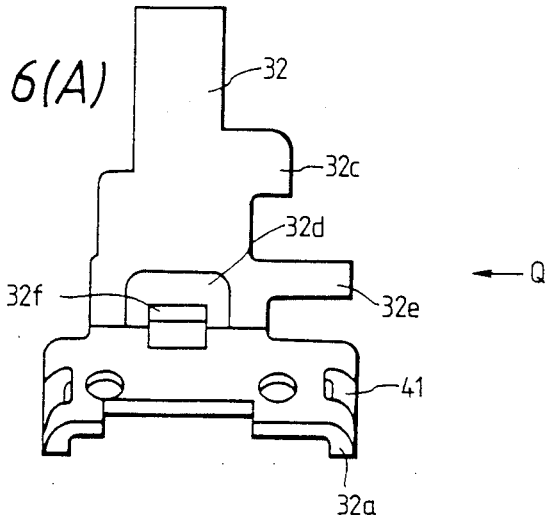
FIG. 6(A) is a front view of the latch receiver.
Figure 6B:
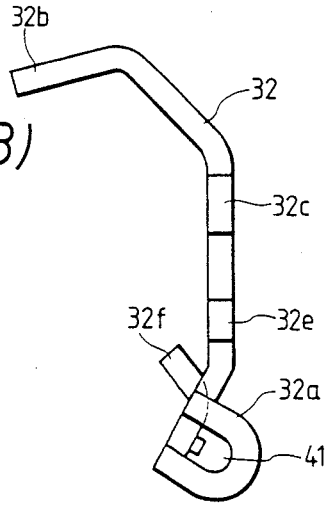
FIG. 6(B) is a front view of the same latch receiver when viewed from the direction shown by arrow Q in FIG. 6(A)

As shown in FIGS. 6(A) and 6(B), latch receiver 32 comprises a steel plate and has support arms 32*a* formed by bending the left and right ends thereof. Bearing holes 41 are formed in support arms 32*a* so that shaft 39 (shown in FIG. 3) is inserted into the bearing holes 41 thereby supporting latch receiver 32. The top end portion of latch receiver 32 extends further than a conventional latch receiver and has two bends as shown in FIG. 6(B) which comprise receiving member 32*b* for receiving the rotating force of latch 30 at the top end of latch receiver 32. Above-mentioned claw 40 of crossbar 28 is engaged with engaging member 32*c* at the back surface of the latter, and claw 30*a* of latch 30 is engaged with notched engaging window 32*d* at the upper edge of the latter. Latch receiver 32 further includes stopper member 32*e* for positioning crossbar 28 and reset member 32*f* for resetting unlocked latch 30.

Figure 7A:
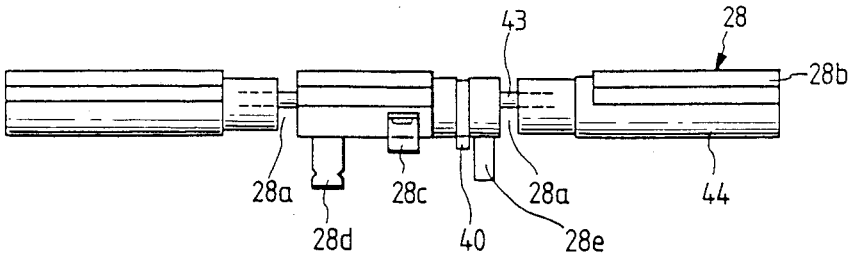
FIG. 7(A) is a plan view of the crossbar.
Figure 7B:
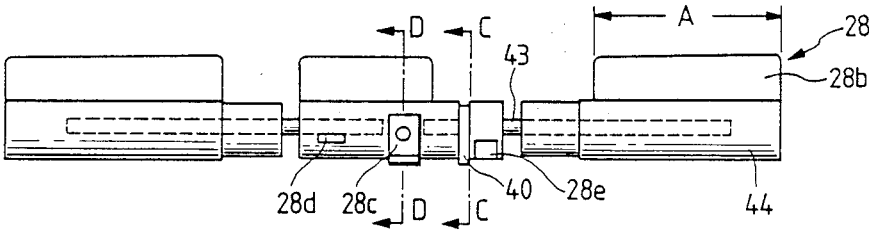
FIG. 7(B) is a front view of the same crossbar.
Figure 7C:
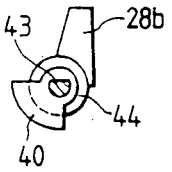
FIG. 7(C) is a sectional view of the same crossbar taken along line C—C in FIG. 7(B)

As shown in FIGS. 7(A) and 7(B), crossbar 28 comprises insulating bar 44 which is molded on core metal 43, and claw 40 which is coupled with insulating bar 44. Crossbar 28 is supported by side plate 29 of FIG. 5(B) at groove portions 28*a* at which core metal 43 is partially exposed. Claw 40 has an outline of a quarter arc and the base portion thereof is pressed into core metal 43 prior to the molding of insulating bar 44.

Figure 7D:
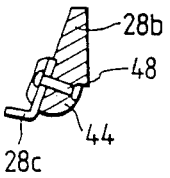
FIG. 7(D) is a sectional view of the same crossbar taken along line D—D in FIG. 7(B)
Figure 8:
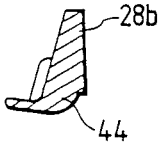
FIG. 8 is a sectional view of another embodiment of the crossbar corresponding to FIG. 7(D)

Arms 28b for receiving the operating force of overcurrent tripping device 25 of FIG. 3 are formed on crossbar 28 for the respective poles of the circuit breaker. Projecting member 28c for receiving a rotational force applied from latch receiver 32, as will be described later, is provided on the central portion of crossbar 28 in the direction substantially perpendicular to arms 28b. Projecting member 28c is made to abut on an upper portion of engaging window 32d of latch receiver 32 of FIGS. 6(A) and 6(B). Projecting member 28c is formed of an L-shaped plate which is fixed to arm 28b with rivet 48 as shown in FIG. 7(D). Alternatively, projecting member 28c may be formed integrally with insulating bar 44 as shown in FIG. 8. Further, crossbar 28 is provided with spring receiving member 28d and positioning member 28e. A return spring (not shown) is stretched between side plate 29 and spring receiving member 28d . Positioning member 28e is made to abut on stopper member 32e of latch receiver 32.

Figure 4:
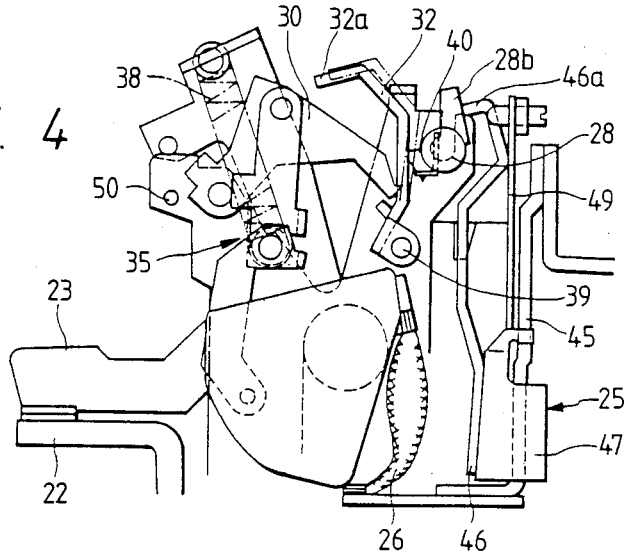
FIG. 4 is a side view of the same switching mechanism portion at the beginning of a tripping operation.

With reference to FIG. 3, if, for example, a short-circuit current flows into the electrical path defined by fixed contact 22, movable contact 23, lead wire 26, and the heater of overcurrent tripping device 25, armature 46, of overcurrent tripping device 25, is attracted by fixed magnet 47 so that arm 28b of crossbar 28 is hit by operating end 46a of armature 46 so that crossbar 28 is rotated counterclockwise to the trip position of FIG. 4. Then, claw 40 of crossbar 28 is disengaged from engaging member 32c of latch receiver 32 so that latch receiver 32 is rotated to the position shown by the dotted line in FIG. 4 by the operation of return spring 48 (shown in FIG. 5(B)) made of a torsion spring provided on shaft 39. Accordingly, claw 30a of latch 30 is disengaged from latch receiver 32 so that latch 30 is rotated counterclockwise to abut on stopper 50 by the operation of switching spring 38. As a result, the spring force of switching spring 39d exceeds the dead point of toggle link 35 so that movable contact 23 is rapidly opened. This tripping operation is also performed in the case where bimetal 49 is heated by heater 45 and transformed so as to hit crossbar 28.

Figure 5A:
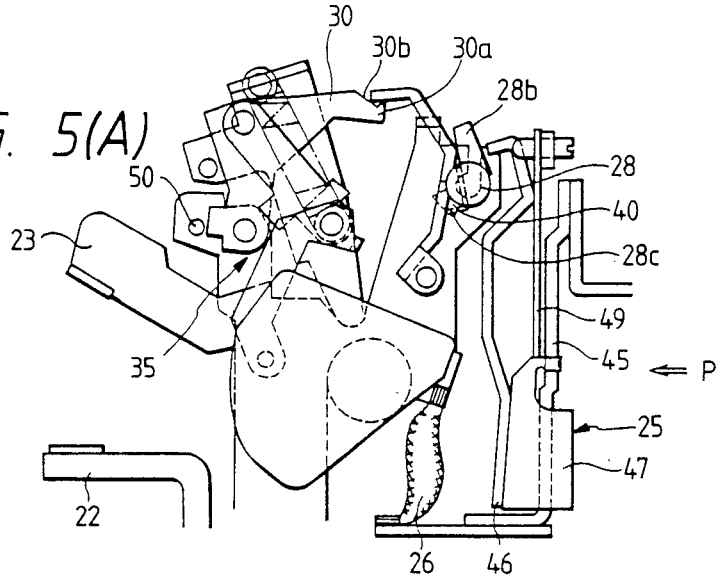
FIG. 5(A) is a side view of the same switching mechanism portion at the completion of a tripping operation.
Figure 5B:
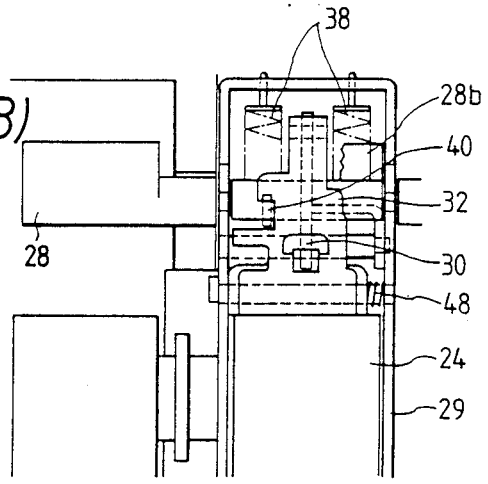
FIG. 5(B) is a front view of the same switching mechanism portion when viewed from the direction shown by arrow P in FIG. 5(A)

As shown in FIGS. 5(A) and 5(B), in the tripped state, movable contacts 23 are opened. Latch 30, which is rotated in the tripping operation, collides with receiving member 32b at slope 30b adjacent to claw 30a of latch 30 so that latch receiver 32 is further rotated clockwise from the operating state of FIG. 3 to the operating state of FIG. 5(A). Latch receiver 32 pushes projecting member 28c so that crossbar 28 is further rotated counterclockwise from the trip position shown in FIG. 3 to the trip position shown in FIG. 5(A). Accordingly, crossbar 28 operates alarm switch 1A. Operation of the present invention will be described hereunder with reference to FIGS. 1(A)–1(B) and 2(A)–2(B).

Figure 1A:
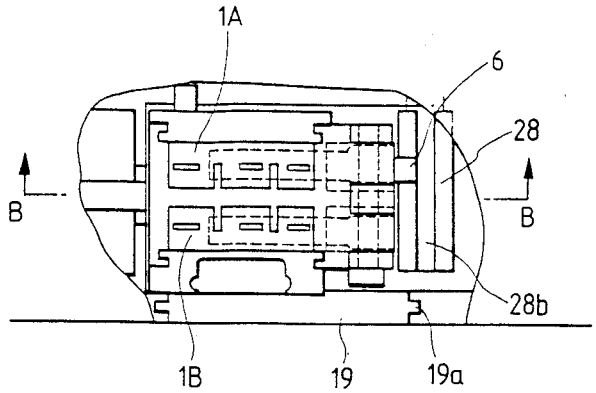
FIG. 1(A) is a plan view showing the alarm switch mount portion at the beginning of a tripping operation.
Figure 1B:
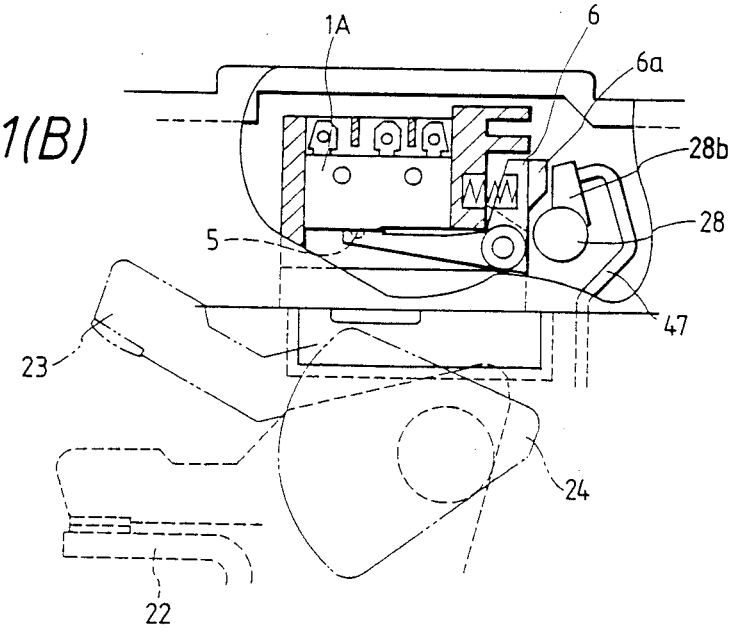
FIG. 1(B) is a sectional view of the same alarm switch mount portion taken along line B—B in FIG. 1(A)
Figure 2A:
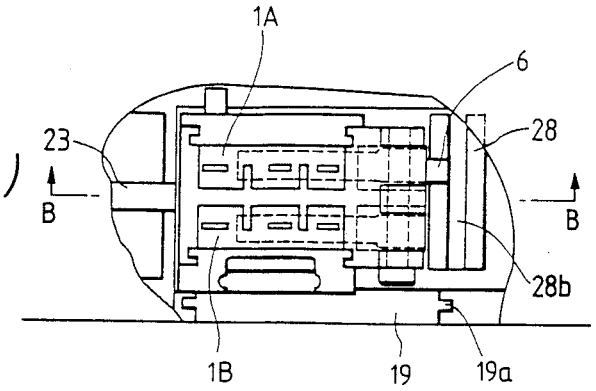
FIG. 2(A) is a plan view showing the same alarm switch mount portion at the completion of a tripping operation.
Figure 2B:
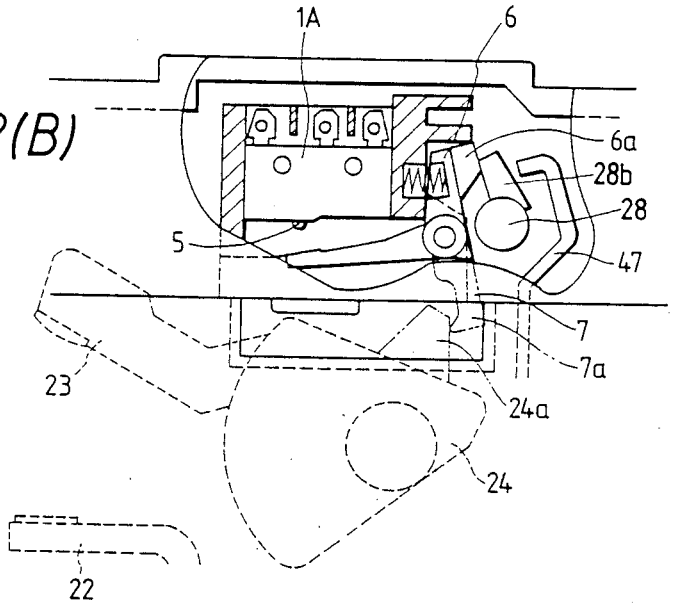
FIG. 2(B) is a sectional view of the same alarm switch mount portion taken along line B—B in FIG. 2(A)

In FIG. 1(B) in which crossbar 28 has been rotated to the trip position, a small gap remains between arm 28b of crossbar 28 and operating portion 6a of actuator 6. Accordingly, the tripping operation applied to crossbar 28 by armature 46 is not at all prevented by actuator 6. Next, when the engagement of latch 30 is released and crossbar 28 is further rotated through latch receiver 32 as described above, crossbar 28 pushes operating portion 6a with arm 28b to thereby rotate actuator 6 counterclockwise. Accordingly, actuator 6 is separated from push button 5 of alarm switch 1A, so that the contact of alarm switch 1A is switched. Accordingly, alarm switch 1A emits a trip signal. At the same time, holder 24 of open movable contacts 23 pushes operating portion 7a of actuator 7 with operating projection 24a formed on the upper portion of holder 24 in the vicinity of the circuit breaker central pole so that auxiliary switch 1B is operated.

Figure 9:
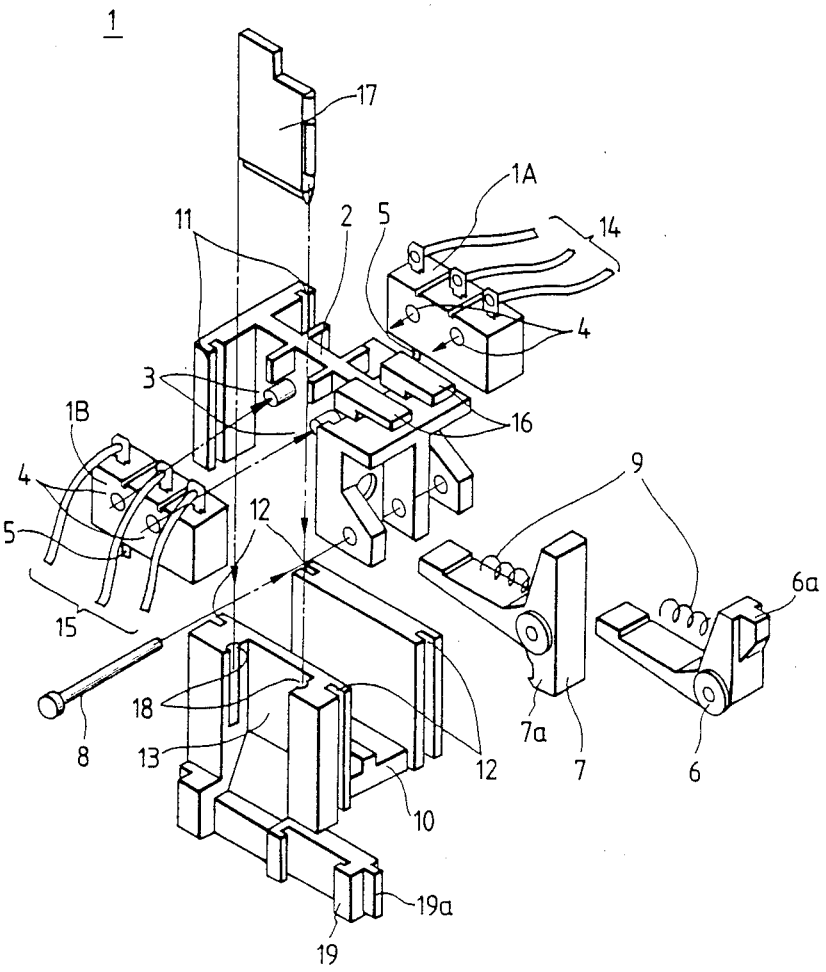
FIG. 9 is an exploded perspective view of the switch unit.
Figure 10A:
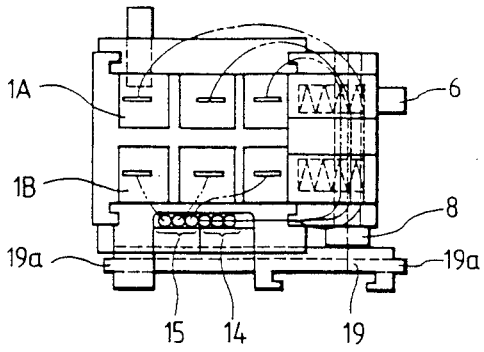
FIG. 10(A) is a plan view of the same switch unit in the assembled state.
Figure 10B:
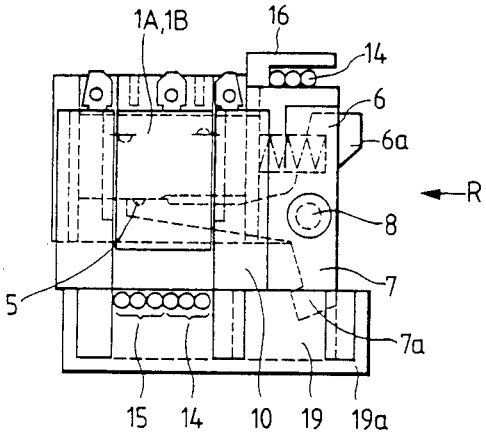
FIG. 10(B) is a side view of the same switch unit in the assembled state.
Figure 10C:
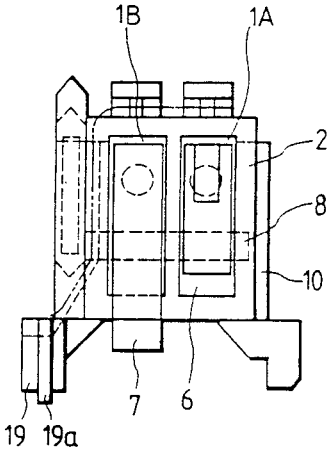
FIG. 10(C) is a front view of the same switch unit in the assembled state when viewed from the direction shown by arrow R in FIG. 10(B)

Although auxiliary switch 1B is for detecting normal switching operation unaccompanied with the operation of crossbar 28, if actuator 7 of auxiliary switch 1B is replaced by another actuator having the same shape as that of actuator 6, and the width A shown in FIG. 7(B) of arm 28b of crossbar 28 is extended over both actuators 6 and 7, both microswitches 1A and 1B can be made to operate as alarm switches. Further, because crossbar 28 is extended across both the left and right poles, if two switch units 1 having configurations plane-symmetrical with each other (specifically, the respective bases 10 of FIG. 9 are made to be plane-symmetrical with each other) are prepared, it possible to provide alarm switch 1A either on one of the left and right poles or on each of the left and right poles.

As described above, according to the illustrated configuration, a plurality of alarm switches can be provided in either one of or both of the left and right poles of the circuit breaker without damaging the insulation between the poles. Further, arm 28b of crossbar 28 for operating actuator 6 has been provided so as to receive the operational force of overcurrent tripping device 25. Still further, receiving member 32a of latch receiver 32 and projecting member 28c of crossbar 28 are selected by adding only some members to conventional ones, so that no completely new parts are added. Therefore, the configuration of the present invention is simple.

According to the present invention, with a simple configuration, a plurality of alarm switches can be provided on either one or both of the left and right poles of a circuit breaker without damaging the insulation between the poles Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. In a circuit breaker having a plurality of poles and means for performing a tripping operation, an alarm switch operating apparatus comprising:

a switch unit housed in each of said plurality of poles;

at least one alarm switch disposed in said switch unit for detecting said tripping operation of said circuit breaker;

a latch rotatably mounted in said switch unit;

rotating means communicating with said latch for rotating said latch;

latch receiver means rotatably supported in said switch unit in communication with said latch for preventing said latch from rotating in absence of said tripping operation;

rotatably supported in communication crossbar means rotatably supported in communication with said latch receiver means, said crossbar means including an insulating bar which extends across said plurality of poles and a claw which engages with said latch receiver means; and first actuating means disposed in said switch unit for actuating said at least one alarm switch, wherein when said tripping operation occurs said crossbar means is rotated to a tripped position by said means for performing said tripping operation, said claw portion and said latch receiver means disengage, said latch is rotated by said rotating means, said crossbar means is further rotated from said tripped position by said latch, and said actuating means activates said at least one alarm switch to emit an alarm signal.

2. The alarm switch operating apparatus of claim 1 further comprising an auxiliary switch disposed in said switch unit for detecting a normal opening and closing operation performed by said circuit breaker.

3. The alarm switch operating apparatus of claim 2-further comprising secondary actuating means for operating said auxiliary switch.

4. The alarm switch operating apparatus of claim 1 wherein said at least one alarm switch comprises two alarm switches disposed in said switch unit.

5. The alarm switch operating apparatus of claim 1 wherein said at least one alarm switch comprises a plurality of alarm switches disposed in said switch unit.

6. The alarm switch operating apparatus of claim 1 wherein said latch includes a claw portion at a top end of said latch, and wherein said claw portion is locked with said latch receiver means prior to said tripping operation.

7. The alarm switch operating apparatus of claim 1 wherein said rotating means comprise a switching spring which rotates said latch to open movable contacts of said circuit breaker.

8. The alarm switch operating apparatus of claim 1 wherein said latch receiver means includes an engaging member, said engaging member being disposed on a back surface of said latch receiver means and wherein said claw of said crossbar means engages said engaging member.

9. The alarm switch operating apparatus of claim 1 wherein said means for performing said tripping operation comprises an overcurrent tripping device, said overcurrent tripping device including an armature rotatably supported in communication with said crossbar means and a fixed magnet, wherein when said tripping operation occurs said armature is attracted to said magnet and said armature rotates said crossbar to said tripped position.

* * * * *

UNITED STATES PATENT AND TRADEMARK OFFICE

CERTIFICATE OF CORRECTION

PATENT NO. : 4,987,395

DATED : January 22, 1991

INVENTOR(S) : Seishiro Ozaki et al.

It is certified that error appears in the above-identified patent and that said Letters Patent is hereby corrected as shown below:

Claim 1, Column 6, Line 63, delete "rotatably supported in communication".

Signed and Sealed this

First Day of December, 1992

*Attest:*

DOUGLAS B. COMER

*Attesting Officer*

*Acting Commissioner of Patents and Trademarks*